US010253969B2

(12) United States Patent
Voaklander

(10) Patent No.: US 10,253,969 B2
(45) Date of Patent: Apr. 9, 2019

(54) BODY BOARD WITH LED LIGHTS

(71) Applicant: Susan Voaklander, Cardiff, CA (US)

(72) Inventor: Susan Voaklander, Cardiff, CA (US)

( * ) Notice: Subject to any disclaimer, the term of this patent is extended or adjusted under 35 U.S.C. 154(b) by 0 days.

(21) Appl. No.: 15/362,414

(22) Filed: Nov. 28, 2016

(65) Prior Publication Data

US 2017/0153018 A1 Jun. 1, 2017

Related U.S. Application Data

(63) Continuation of application No. 62/261,192, filed on Nov. 30, 2015.

(51) Int. Cl.

| | |
|---|---|
| ***F21V 33/00*** | (2006.01) |
| ***F21S 4/10*** | (2016.01) |
| ***F21S 9/03*** | (2006.01) |
| ***F21V 3/00*** | (2015.01) |
| ***F21V 31/00*** | (2006.01) |
| ***F21V 23/04*** | (2006.01) |
| ***B63B 35/79*** | (2006.01) |
| ***B63B 45/00*** | (2006.01) |
| *F21Y 115/10* | (2016.01) |

(52) U.S. Cl.

CPC ..... *F21V 33/008* (2013.01); *B63B 35/7906* (2013.01); *B63B 45/00* (2013.01); *F21S 4/10* (2016.01); *F21S 9/03* (2013.01); *F21V 3/00* (2013.01); *F21V 23/04* (2013.01); *F21V 31/005* (2013.01); *B63B 2035/7903* (2013.01); *F21Y 2115/10* (2016.08)

(58) Field of Classification Search

CPC ..... B63B 35/79–35/7909; B63B 45/00–45/06

See application file for complete search history.

(56) References Cited

U.S. PATENT DOCUMENTS

2014/0063828 A1* 3/2014 Roach ..... B63B 35/7933 362/477

2015/0217675 A1* 8/2015 Dayan ..... A63C 5/03 362/544

* cited by examiner

*Primary Examiner* — Sean P Gramling

(74) *Attorney, Agent, or Firm* — Eric Hanscom

(57) ABSTRACT

This invention is directed toward a body board, used for riding ocean waves, paddling through standing water, and other aquatic uses, which has one or more strings of optionally removable LED lights disposed in one or more channels that have been molded or routed into the top, bottom, or sides of the body board. The channels are, in one embodiment, removably covered with a water-resistant covering that can be opened to remove or exchange the LED lights. The body board also includes a cavity into which a battery (optionally, with a solar charger) is placed, where the battery powers the LED's, and means of controlling the LED's. The battery cavity, in the first embodiment, is also covered by a water-resistant covering that can be opened to access the battery for removal or replacement. In a second embodiment, the cover is permanent, allowing for a more waterproof cover.

16 Claims, 3 Drawing Sheets

BODY BOARD WITH LED LIGHTS

CROSS REFERENCE TO RELATED APPLICATIONS

This application claims priority to U.S. Provisional Application No. 62/261,192 filed Nov. 30, 2015, which is attached to this application and the contents of which are incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of body boards, and more specifically, to a body board with channels that contain LED light strings. The LED light strings can be permanent or removable. The goal of the invention is to provide a lighted body board for use in the ocean, rivers, or other bodies of water, where the lights form some sort of decorative pattern and/or providing some sort of benefit to the user via the use and/or pattern of the lights.

Brief Summary of the Invention

In one embodiment, the channels are covered by a removable, water-resistant covering that allows a user to access the LED light strings for removal or replacement, such that a user can custom tailor the appearance of the board to his or her preference. It is contemplated that the channels in the body board can be on some combination of the sides, top and bottom of the board, and can be effectively waterproofed such that a user of the invention can take out the strings of LED's and replace them with others—perhaps of a different color or type—then seal back up the channel and put the body board back in the water. The LED's are powered by a battery that rests in a cavity in the body board, where the cavity is also covered by a water-resistant covering. This allows a user to remove the battery for recharging/replacement. There is also a controller that regulates flow of electrical current from the battery to the LED light strings. This controller can be manually operated on the body board itself, or remote controlled through the use of RF frequencies.

The general concept behind this invention is that it can be used with a variety of board sizes and shapes. While the average "adult" body board is used for purposes of illustration in this application, it is also contemplated that a similar board could be created for children, and even a larger, rescue board version created for lifeguards, coast guard personnel, and other water rescue professionals. The invention is equally applicable to floating devices other than body boards, such as rafts, pool toys, Styrofoam floats, solid inner tubes, and any other device that floats on water and is usable by a person.

In another embodiment, the channels are covered by a non-removable, transparent or translucent cover, such that the LED light strings cannot be removed. In this, and other, embodiments, an internal battery provides the power. This battery is preferably permanently located in a cavity within the body board, and charged through a connect to one or more solar panels.

History of the invention's industry. Surfing and body boards have been known in the prior art for many decades. Surfboards can be decorated in a variety of ways, including airbrushing the foam blank and using different colors of resins. Body boards, on the other hand, are generally made from a molded piece of foam covered "skins" that cover the top, bottom, and sides. These skins can be of different colors, and have designs imprinted on them. One embodiment has fiberclad covers with, optionally, characters on the covers.

The concept of "night surfing" has also been around for decades, as surfers and body boarders try to escape the ever-growing crowds by using a variety of headlamps and other devices to surf during night time.

However, the idea of using lights impregnated into a body board has not been seen in the industry. The current invention combines the best of decorative art and lighting to meet the long-felt need for a customizable body board that also provides safety features.

Thus, the invention is hereby presented. The invention is directed toward a body board, used for riding ocean waves, paddling in lakes and pools, and other aquatic uses. The board has one or more strings of optionally removable LED lights disposed in one or more channels that have been molded or routed into the top, bottom, or sides of the body board. The channels are optionally covered with a water-resistant covering that can be opened to remove or exchange the LED lights. Two or more "grippers" can anchor the cover in place until it is desired to remove the cover. The body board also includes a cavity into which a battery is placed, where the battery powers the LED's, and means of controlling the LED's. The battery cavity is also covered by a water-resistant covering that can be optionally opened to access the battery for removal or replacement.

The invention has two distinct embodiments. First, a preferred embodiment calls for the channels to have a removable cover, such that a user can replace damaged lights and/or customize the lights and patterns through removing the old LED strings and replacing them with new LED strings. Second, a less expensive model calls for the LED light strings to be placed in the channels and covered by a permanent covering. While the user will not be able to access the channels to remove and replace LED light strings, the second embodiment will be less expensive to create and will have greater water-resistance, as there will be no need to make the covers removable. It is also contemplated, with both versions, that a waterproof, solar battery can be installed permanently inside a cavity within the body board, and electrically connected to solar panels also contained within the board, such that the battery is charged by the sun without the need to hook the battery up to an external source of power.

Further, alternative embodiments include having the LED strings removable, but the battery and control permanent, or having the battery and control removable, but the LED light strings are permanent. By make the battery and control removable, it only requires a manufacturer to make the battery compartment waterproof and accessible, which will be easier than creating a removable decorative pattern along a non-flat surface, such as that found on a rail or a curved deck or bottom. Additional embodiments call for LED light strings to be in some combination of deck, rails, and underside of the board. Another embodiment of the idea is to have a remote controller, either a hand-held external device or an internal device, which can be manipulated by the user while the user is using the invention. The controller could control a number of variations of the lights, including changing the color, changing the intensity, operating a flashing sequence, etc.

OBJECTS OF THE INVENTION

It is therefore an object of the present invention to provide an enjoyable toy to a youngster who desires a body board with colored LED lights creating a decoration on the body board, where the body board could be used in any aquatic environment, including but not limited to the ocean, lakes, swimming pools, water parks, rivers, bays and estuaries.

Other objects of the invention include a) allowing a user to customize the body board to create a variety of colors and flashing patters with the LED light strings, b) providing a waterproof channel in which the LED light strings lie, c) enhancing the safety of the bodyboarding experience by providing LED's light to help locate a user or the body board, and enhancing the experience of the user by allowing the user to rely upon the LED light strings for enhanced visibility and/or better "night surfing" experiences, d) providing a removable channel that will allow a user to replace existing LED light strings to change the color and/or flashing pattern, and, e) providing a waterproof, permanent, transparent or translucent covering over the channels in an alternative embodiment of the idea, and as an additional embodiment, containing a solar-powered, waterproof battery that is contained in a non-removable compartment, such that it remains charged from the solar cells attached to it.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects, and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

REFERENCE NUMBERS USED

1. Body board deck
2. Body board rails
3. Body board bow
4. Body board stern
5. Channel
6. LED light string
7. Cover
8. Grippers
9. Battery compartment. Can be opened to remove and replace battery, or, alternatively, can be sealed with a battery inside that is connected to a solar charging system located on the deck, sides, or bottom of the board.
10. Access screw.
11. Waterproof control button
12. Decorative pattern.
13. Battery compartment cover, which is water resistant. Can be optionally a fiberclad cover, with or without characters.

BRIEF DESCRIPTION OF THE FIGURES

One preferred form of the invention will now be described with reference to the accompanying drawings.

DETAILED DESCRIPTION OF THE FIGURES

Figures 1, 2:
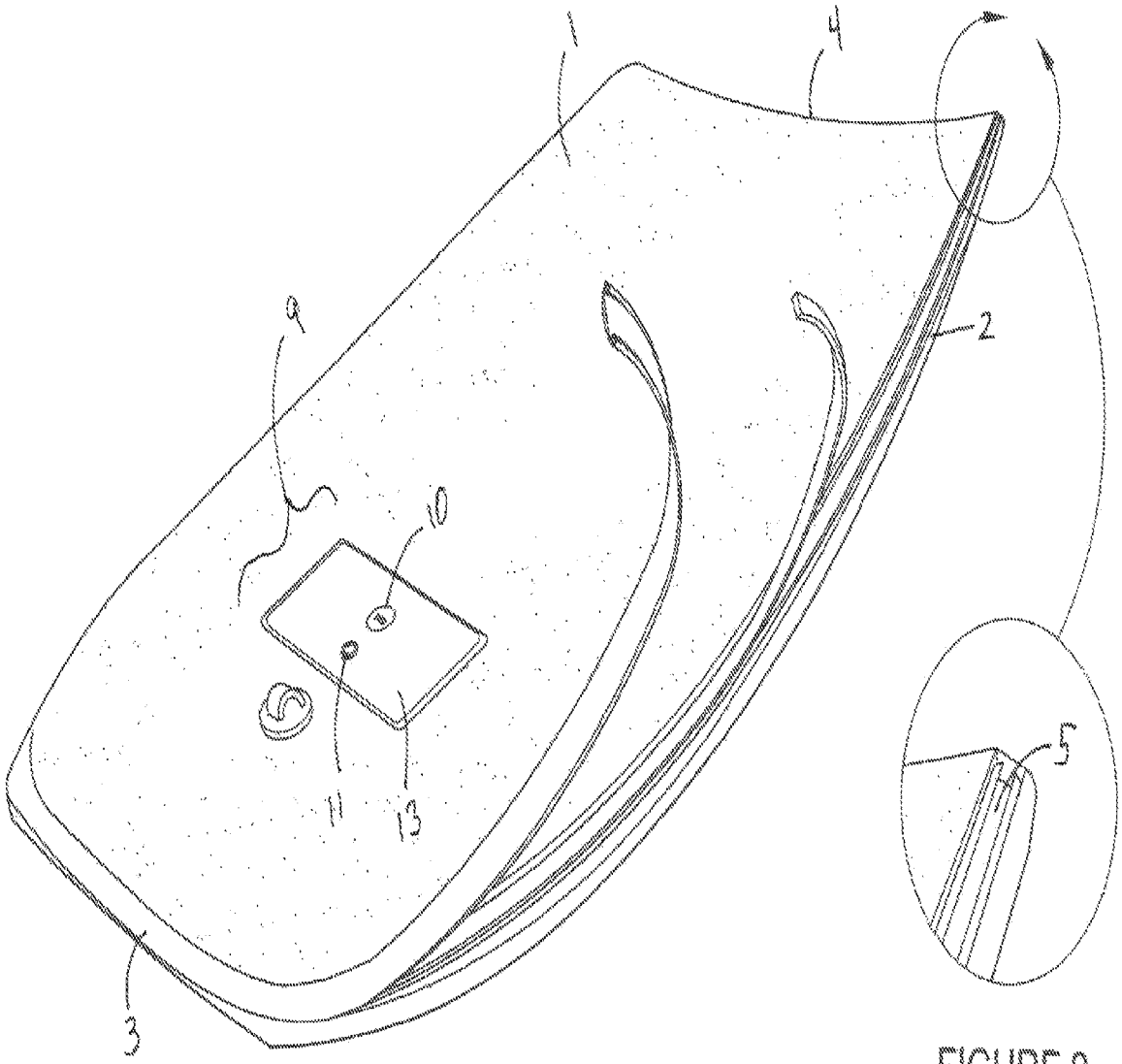
FIG. 1 is a perspective view of a body board with embedded LED lights according to a preferred form of the invention.
FIG. 2 is a close-up view of the "channel" into which the LED light string is placed.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a perspective view of a body board with embedded LED lights according to a preferred form of the invention. The body board has a deck 1, rails 2, a bow 3 and a stern 4. On the deck 1 there is a battery compartment 9, into which the battery is removably secured. The battery compartment is waterproof due to a battery compartment cover 13, that can be removed through an access screw 10. The battery can be turned on and off through a waterproof control button 11 and can be charged through a waterproof charging port. From the battery, one or more strings of LED is dispensed in channels routed into the deck, rails and/or bottom of the body board. To use the invention, the user inserts LED lights into the channels, secures a waterproof cover, turns on the LED lights by pushing the waterproof control button, and goes bodyboarding.

FIG. 2 is a close-up view of the "channel" 5 into which the LED light string is placed according to a preferred form of the invention.

Figure 3:
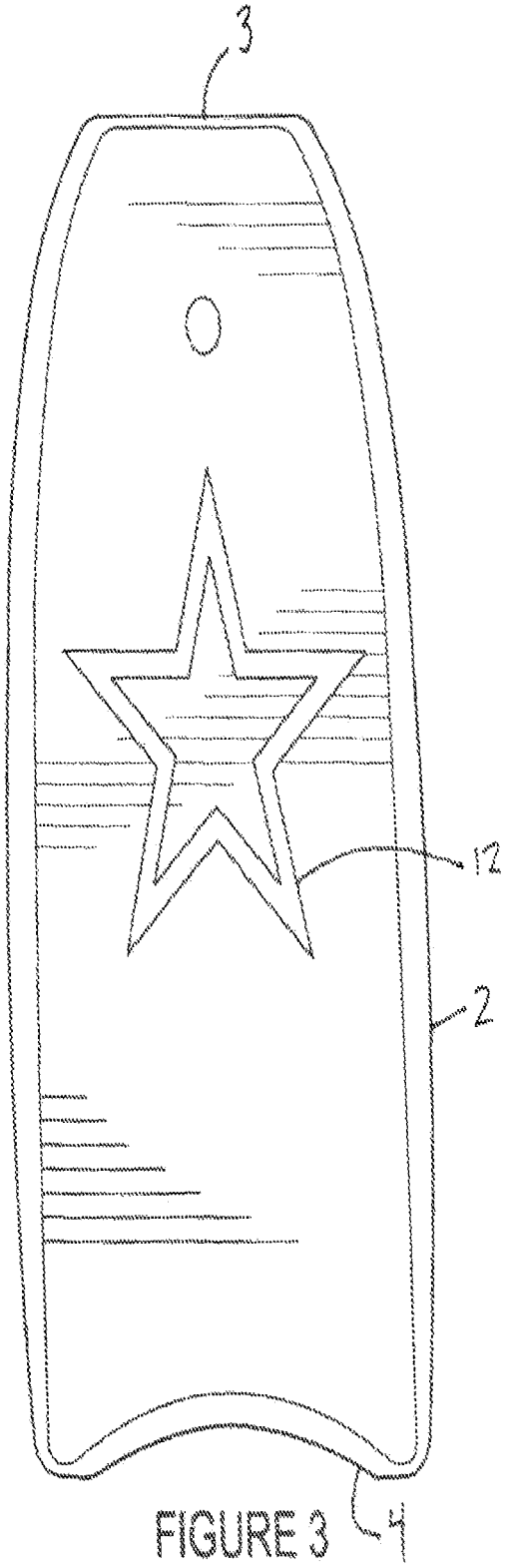
FIG. 3 is a bottom view of a body board with embedded LED lights according to a preferred form of the invention.

FIG. 3 is a bottom view of a body board with embedded LED lights according to a preferred form of the invention. In the particular embodiment, a decorative pattern 12 is created in the shape of a star. It should be noted that the LED light strings can be placed anywhere on the board, including the bottom, as shown here, the deck, the rails 2, and even the bow 3 and stern 4.

Figure 4:
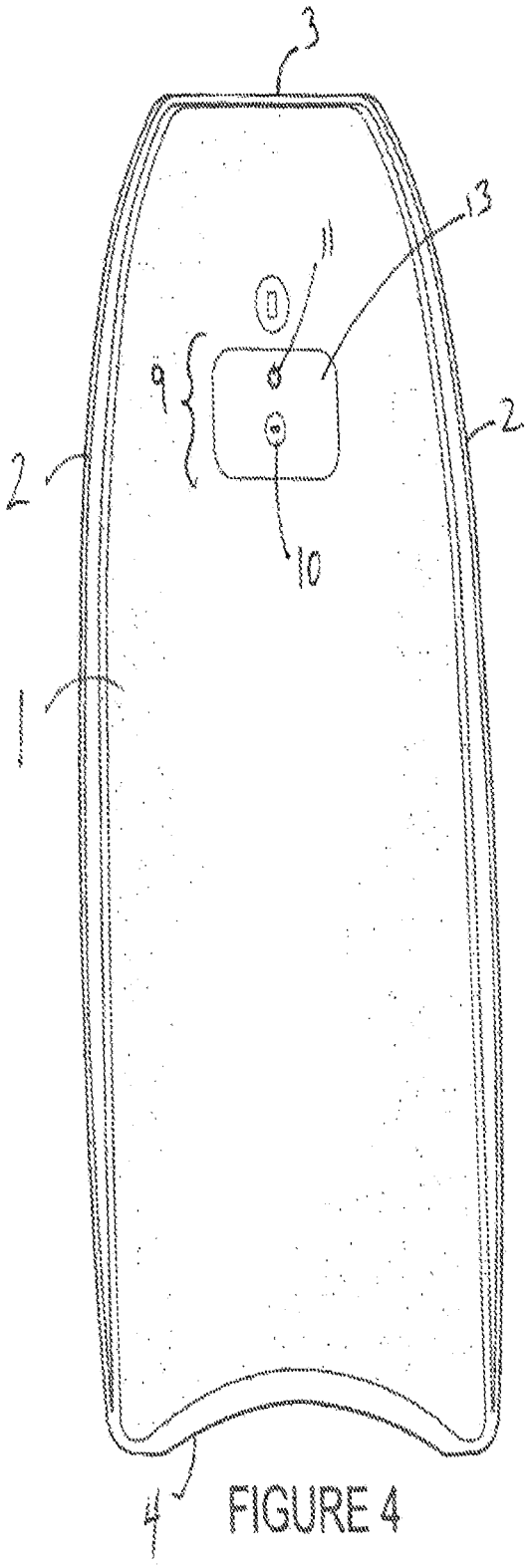
FIG. 4 is a top view of a body board with embedded LED lights according to a preferred form of the invention.

FIG. 4 is a top view of a body board with embedded LED lights according to a preferred form of the invention. The battery compartment 9 is a cavity that has been molded or routed into the deck, in this case, of the body board. Inside the battery compartment is a battery (not shown in this figure), which is covered by a waterproof battery compartment cover 13. There are several possible embodiments of the battery. First, it could be a water-resistant battery enclosed in a removable, water-resistant cover such that the battery could be removed for recharging. Second, the battery could be permanently encased by a non-removable cover where the battery is electrically attached to one or more solar panels attached to the top, side, or bottom of the board, or even resting on or embedded in the cover itself. The battery and the LED light strings are controlled through a waterproof control button 11 which can be pushed to turn the LED light strings on and off. In another embodiment of the invention, the waterproof control button 11 has several different settings that cause different light patterns to illuminate in the LED light strings. The battery compartment cover 13 forms a waterproof seal over the battery compartment 9, and can be accessed through an access screw 10. Thus, before the user enters the water he/she can turn on the LED lights, then enjoy a water session, before returning to dry land and removing the battery for charging. In another embodiment, a waterproof charging station is included in the battery compartment cover 13 so that that user can charge the battery while the battery is still in the battery compartment. Again, it is contemplated that while a preferred embodiment of the invention calls for the LED light strings to form a decorative pattern on the bottom of the body board, as in FIG. 3, it is also contemplated that LED light strings could be places on the rails 2, deck 1, or even the bow 3 and stern 4. It is further contemplated that LED lights, including strong ones, could be mounted on the bow 3 of the body board to enhance the user's ability to see during low light and night time conditions.

Figure 5:
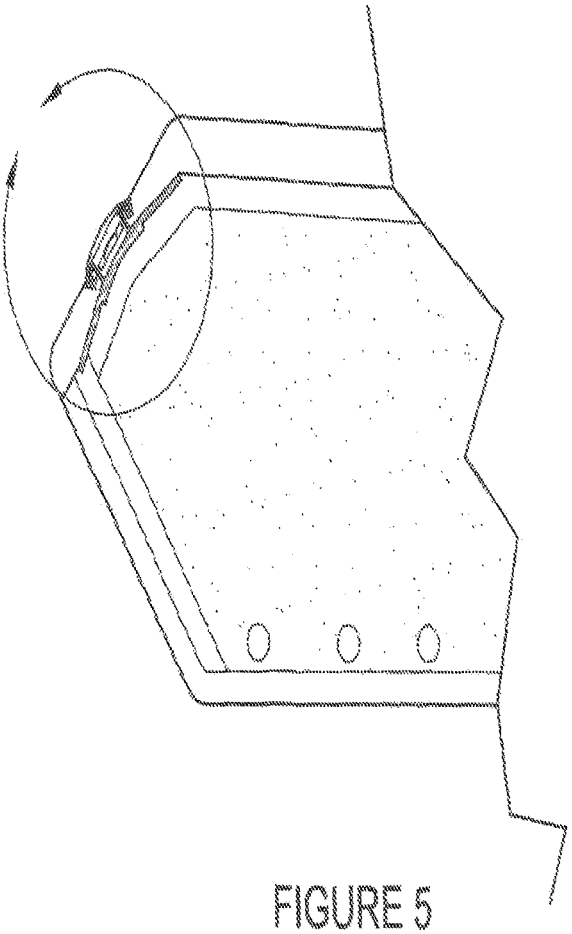
FIGS. 5 through 7 are cross sectional views of the channel in which the LED lights are placed.
Figure 6:
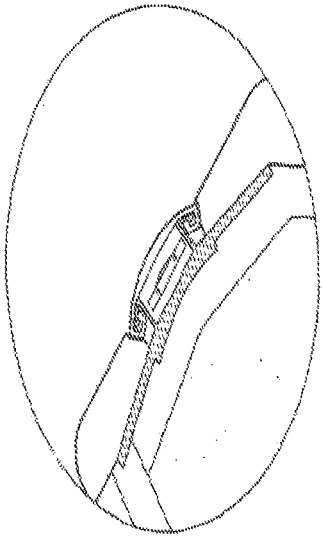
Figure 7:
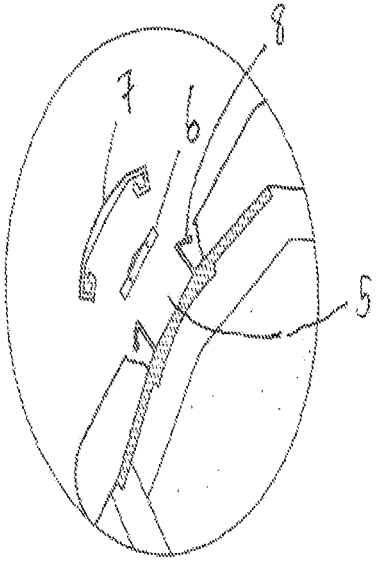

FIGS. 5 through 7 are cross sectional views of the channel in which the LED lights are placed. An LED light string 6 is placed in a channel 5. A waterproof cover 7, is secured with grippers 8, such that water does not flood the channel 5. If the user wishes to change the colors, or flashing pattern of the LED's, he/she need only to remove the waterproof cover 7, and replace the LED light string 6 with another one. In another embodiment, there are more than one color of lights in the channel, or the lights are capable of changing color, in which case it is not necessary to remove them from the channel, but rather a user can change the colors by merely pushing a control button or using a remote controller.

It should also be noted that a non-replaceable, less expensive version of the invention is contemplated where the waterproof cover 7 is actually affixed permanently to seal the LED light string 5 into the channel 5. Along with the non-replaceable LED light string, it is contemplated that a permanently-enclosed battery, powered by an external solar charger, could also be embedded permanently in the board.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A body board for surfing ocean waves with LED light decorations, comprising: a body board, where the body board has a deck, a bottom, a bow, a stern, and two rails, where the two rails comprise a port rail and a starboard rail, where the body board has a length, where the body board has a height, at least one channel, where the at least one channel is molded by a molding process, where the molding process created the at least one channel into the body board, at least one LED light string comprising LED lights, a cover, a battery, a battery compartment, and a battery compartment cover, where the at least one channel comprises a cavity with a cavity width, a cavity length, and a cavity depth, where the at least one LED light string is disposed in the at least one channel, and covered by the cover, and the battery is disposed in the battery compartment, and covered by the battery compartment cover, and where the at least one LED light string is electronically attached to the battery, where the cover is removable such that a user can remove a first type of LED light string and replace it with a second type of LED light string, where the body board additionally comprises one or more solar panels, and the one or more solar panels provides an amount of recharging energy to the battery whenever the body board is left in a sunny location, where the one or more solar panels are integrated into the deck of the body board, where the body board comprises at least three channels, where the at least three channels include a deck channel, a bottom channel, and a rail channel, and where the deck channel is located on the deck, where the bottom channel is located on the bottom, and where the rail channel is located on the rail, where the length is less than four feet.

2. The body board of claim 1, where the body board additionally comprises one or more grippers, where the one or more grippers removably retain the cover, such that a user of the invention can open the cover to replace at least one LED light string with a second LED light string.

3. The body board of claim 1, where the body board has a flexible core and has the capacity to remain unbroken when used in average six-foot surf where the height of the body board is less than two inches where the LED light string serves a decorative purpose only, and where the body board does not have any handles or straps.

4. A body board for surfing ocean waves with LED light decorations, comprising: a body board, where the body board has a deck, a bottom, a bow, a stern, and two rails, where the two rails comprise a port rail and a starboard rail, where the body board has a length, where the body board has a height, at least one channel, where the at least one channel was formed by a molding process, where the molding process created the at least one channel into the body board, at least one LED light string comprising LED lights, a cover, a battery, a battery compartment, and a battery compartment cover, where the channel comprises a cavity with a cavity width, a cavity length, and a cavity depth, where the at least one LED light string is disposed in the at least one channel, and covered by the cover, and the battery is disposed in the battery compartment, and covered by the battery compartment cover, and where the at least one LED light string is electronically attached to the battery and, where the cover is removable such that a user can remove a first type of light string and replace it with a second type of light string.

5. The body board of claim 4, where the body board does not have any handles or straps and where the height of the body board is less than two inches.

6. The body board of claim 4, where the body board additionally comprises one or more solar panels, and the one or more solar panels provided an amount of recharging energy to the battery whenever the body board is left in a sunny location, where the solar panels are integrated into the deck of the body board.

7. The body board of claim 4, where the body board comprises at least three channels, where the at least three channels include a deck channel, a bottom channel, and a rail channel, and where the deck channel is located on the deck, where the bottom channel is located on the bottom, and where the rail channel is located on the rail.

8. The body board of claim 4, where the body board comprises at least four channels, where the at least four channels include a deck channel, a bottom channel, and two rail channels, and where the deck channel is located on the deck, where the bottom channel is located on the bottom, and where one of the two rail channels is located on the port rail, and one of the two rail channels is located on the starboard rail.

9. The body board of claim 4, where the length is less than four feet.

10. The body board of claim 4, where the body board additionally comprises one or more grippers, where the one or more grippers removably retain the cover, such that a user of the invention can open the cover to replace at least one LED light string with a second LED light string.

11. The body board of claim 4, where the body board has a flexible core and has the capacity to remain unbroken when used in average six-foot surf.

12. The body board of claim 4, where the LED light string serves a decorative purpose only.

13. The body board of claim 4, the battery compartment cover is waterproof, and, where the battery compartment cover additionally comprises an access screw, where the access screw can be used to remove the battery compartment cover to allow access to the battery, and, where the cover is made from fiberclad material.

14. The body board of claim 4, where the cover additionally comprises one or more artistic embellishments, and, where the battery compartment cover additionally comprises a waterproof control button, where the waterproof control button can be pushed by the user to turn on and turn off the LED lights.

15. The body board of claim 4, where the at least one channel has a creative shape, where the creative shape is an eye-pleasing shape, where the battery compartment cover is permanent and waterproof, and where the battery compartment cover additionally comprises a waterproof control button, where the waterproof control button can be pushed by the user to turn on and turn off the LED lights.

16. The body board of claim 4, where the at least one channel has a creative shape, where the creative shape is an eye-pleasing shape, where the battery is waterproof battery and is electrically connected to a solar charging source, where the solar charging source is one or more solar panels, where the one or more solar panels are integrated into the deck of the body board.

* * * * *